US005143466A

United States Patent [19]

Moncrieff Baldwin et al.

[11] Patent Number: 5,143,466

[45] Date of Patent: Sep. 1, 1992

[54] NOTEBOOK PAGE WITH PRESSURE-SENSITIVE REPOSITIONABLE LABELS ON BOTH SIDES THEREOF

[75] Inventors: Judith A. Moncrieff Baldwin, New York; Suzanne Wozniak, Brookyln, both of N.Y.

[73] Assignee: Strategic Financial Communications Corp., New York, N.Y.

[21] Appl. No.: 810,530

[22] Filed: Dec. 18, 1991

Related U.S. Application Data

[63] Continuation of Ser. No. 608,241, Nov. 2, 1990, abandoned.

[51] Int. Cl.[5] ..... B42F 13/00

[52] U.S. Cl. ..... 402/79; 402/80 R; 402/80 P; 283/81; 283/61; 428/42

[58] Field of Search ..... 283/81, 46, 61; 402/79, 402/80 R, 80 P; 428/40, 42

[56] References Cited

U.S. PATENT DOCUMENTS

| | | | |
|---|---|---|---|
| 2,213,666 | 9/1940 | Burke | 283/81 |
| 3,290,059 | 12/1966 | Newman | 283/81 |
| 3,706,626 | 12/1972 | Smith et al. | 428/42 |
| 3,938,698 | 2/1976 | McDavid, Jr. et al. | 156/566 |
| 4,190,268 | 2/1980 | Webster | 283/72 |
| 4,634,146 | 1/1987 | Yaniv | 283/43 |
| 4,802,855 | 2/1989 | Wood | 283/46 |
| 4,876,131 | 10/1989 | Ashby et al. | 428/42 |
| 4,907,904 | 3/1990 | Baldwin | 283/43 |

*Primary Examiner*—P. W. Echols
*Assistant Examiner*—David P. Bryant
*Attorney, Agent, or Firm*—Schweitzer Cornman & Gross

[57] ABSTRACT

A notebook page with repositionable labels on both sides thereof. Each side of the page is covered with a web of pressure-sensitive label stock which is kiss die cut to form removable, repositionable labels within permanent matrices. The matrices define zones which facilitate repositioning of the removed labels.

3 Claims, 3 Drawing Sheets

NOTEBOOK PAGE WITH PRESSURE-SENSITIVE REPOSITIONABLE LABELS ON BOTH SIDES THEREOF

This is a continuation of Ser. No. 608,241, filed Nov. 2, 1990, now abandoned.

BACKGROUND OF THE INVENTION

It is well known that address books, telephone books, daily dairies and other personal books in which information (in the form of names, addresses, telephone numbers, calendar dates and the like) is recorded for future reference often become cluttered and of reduced usefulness through the passage of time. This is typically due to the repeated need to amend entries, remove them, or to rearrange them, entailing messy erasures, strikeovers, white-outs, and similar awkward editorial endeavors.

The most common solution to the problem has been to simply replace these books on a regular basis requiring the time-consuming reentry of information from the old book to the new. Other solutions have included the use of selectively removable and rearrangeable pages (such as in loose-leaf notebooks). However, this system allows saving and/or rearranging of full pages of information rather than individual entries. Another solution has entailed the use of pages having multiple transparent pockets into which individual business cards or other information bearing elements may be inserted, removed and/or rearranged.

A new and improved personal information system for maintaining, on a semipermanent basis, the type of personal information described hereinabove, has been developed and is embodied in the notebooks described and claimed in Judith A. M. Baldwin U.S. Pat. No. 4,907,904, the details of which are herein incorporated by reference.

Specifically, the patented notebooks may be in bound or loose-leaf form, with the salient features being the association with and inclusion within the book of a supply of information carriers in the form of repositionable, pressure-sensitive adhesive coated labels, either blank or printed with information such as name, address and telephone number(s) or other calendar or reminder information, and special coated pages for readily removably mounting the pressure-sensitive adhesive labels.

The individual labels or information carriers, after being initially filled in with information, may be repalced or repositioned as desired in the appropriately indexed portion of the book.

The present invention is directed to an improved method of manufacturing two-sided label stock for use as pages in said notebooks in which pages have information carriers, within or without their matrices, on the front and obverse sides thereof, and which pages may be manufactured economically by available mass production techniques as in the manner to be described hereinafter. The improved construction of the two-sided label stock having removable, repositionable information carriers on both sides may be used in applications other than notebooks, for example the pages may be used to double the typical supply of pressure-sensitive labels ordinarily supplied in sheet or roll-form, with labels only on one side. They may be used to fill the applications gaps which exist in the ever-expanding repositionable label field due to the commercial availability of only one-sided label stock.

Accordingly, it is to providing a method of making new and improved two-sided repositionable label stock and the resulting label stock itself to which the present invention is directed.

SUMMARY OF THE PRESENT INVENTION

One sided repositionable label stock and/or repositionable pressure-sensitive adhesives used in their manufacture and in the manufacture of repositionable note paper are well known and are available in the commercial products of Avery International Corp., Pasadena, Calif. and Minnesota Mining and Manufacturing Co., St. Paul, Minn., among others. Indeed the prior art includes descriptions of note paper pads and dispensers for such pads which have repositionable pressure sensitive adhesives which are employed to advantage in the product of the new two-sided multi-repositionable label stock. These adhesives typically are infusible, inherently tacky, elastomeric microspheres prepared by an aqueous suspension polymerization process. Aqueous suspension polymerization processes are described, for example, in U.S. Pat. No. 3,691,140 to Silver; U.S. Pat. No. 4,166,152 to Baker et. al.; U.S. Pat. Nos. 4,495,318 and 4,598,212 to Howard; U.S. Pat. No. 4,786,696 to Bohnel; and U.S. Pat. Nos. 4,810,763 and 4,944,888 to Mallya et. al., each of which by reference is incorporated herein. The Mallya et. al. patent discloses inherently tacky infusible pressure-sensitive adhesive microspheres prepared by polymerizing at least one monomer which when polymerized will form a pressure-sensitive adhesive having a glass transition temperature less than about −20° C. in a medium in which the monomer is substantially insoluble and in the presence of a surfactant and a suspension stabilizer which are soluble in the organic medium and substantially insoluble in the monomer under conditions of shear sufficient to form suspended particles of a size less than 20 microns. The formed microspheres are transferred to a volatile organic medium and separated from the medium in which they were formed by a centrifugal separator at a force of at least 2,000 times the force of gravity. For brevity of description, these specific adhesives which are formulated to be reliably repositionable at least 7 times on calendered or supercalendered paper liner material or thermoplastic liner material or any other compatible liner material, are hereinafter referred to in abbreviated form as multi-repositionable pressure sensitive adhesive.

The new and improved method for manufacturing two-sided pages of information carriers, i.e. repositionable labels on the front and back surfaces thereof, within or without their matrices, generally includes the fundamental steps of:

(a) supplying a first roll of multi-repositionable pressure-sensitive adhesive transfer coated paper label stock laminated to a first silicone coated carrier sheet;

(b) providing a similar second roll of multi-repositionable pressure-sensitive transfer coated paper label stock laminated to a second silicone coated carrier sheet;

(c) supplying a roll of paper or plastic liner stock and directing said first and second rolls to delaminating stations;

(d) stripping said first and second carriers from said first and second rolls of label stock to expose said pressure-sensitive adhesive;

(e) directing webs of said first stripped label stock and said second stripped label stock to a laminating nip;

(f) laminating said first and second label stock to the front and rear faces respectively of said liner stock;

(g) forming individual removable, repositionable labels by die cutting techniques; and/or (h) directing said laminated two-sided label stock into a finishing station where it may be continuously wound into rolls or sheeted.

For more complete understanding of the new and improved method of manufacturing pages of multi-repositionable pressure-sensitive information carriers on the front and rear surfaces thereof, and for a better appreciation of the advantages to be derived from the new methods and the resultant improved products, reference should be made to the following detailed description of the invention, taken in conjunction with the accompanying drawings.

DETAILED DESCRIPTION OF THE INVENTION

Figure 2:
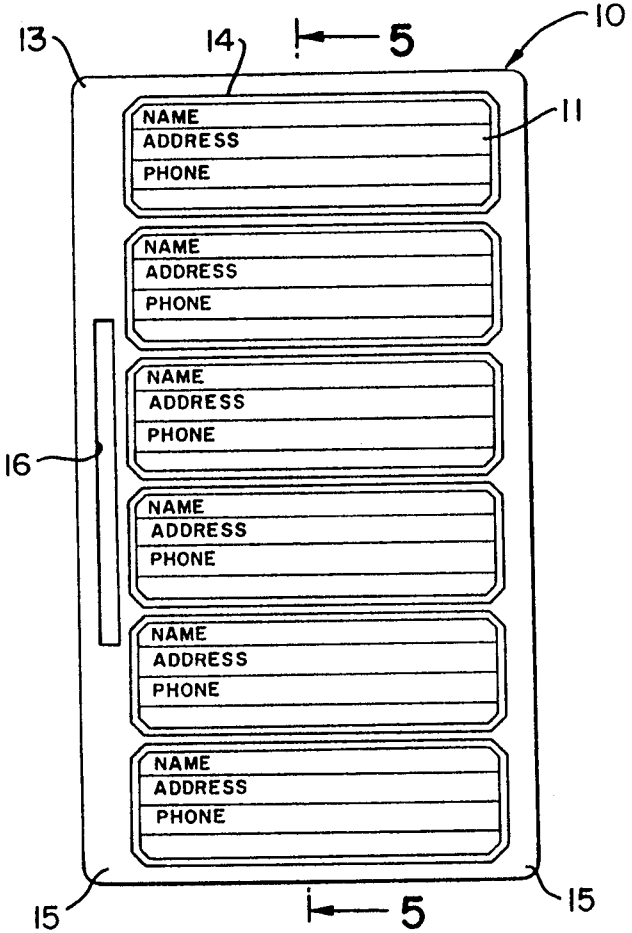
FIG. 2 is front elevational view of a new and improved notebook page embodying the present invention.
Figure 5:
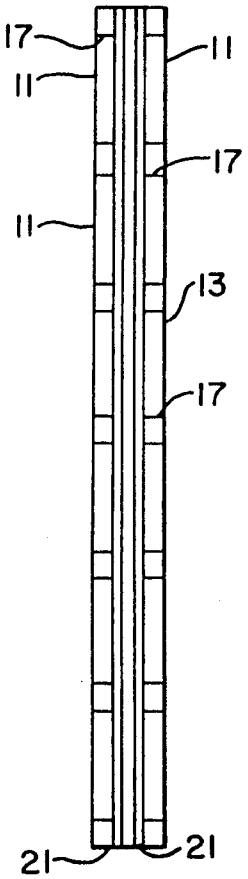
FIG. 5 is a cross sectional view of the page of FIG. 2. taken along line 5-5 thereof.
Figure 4:
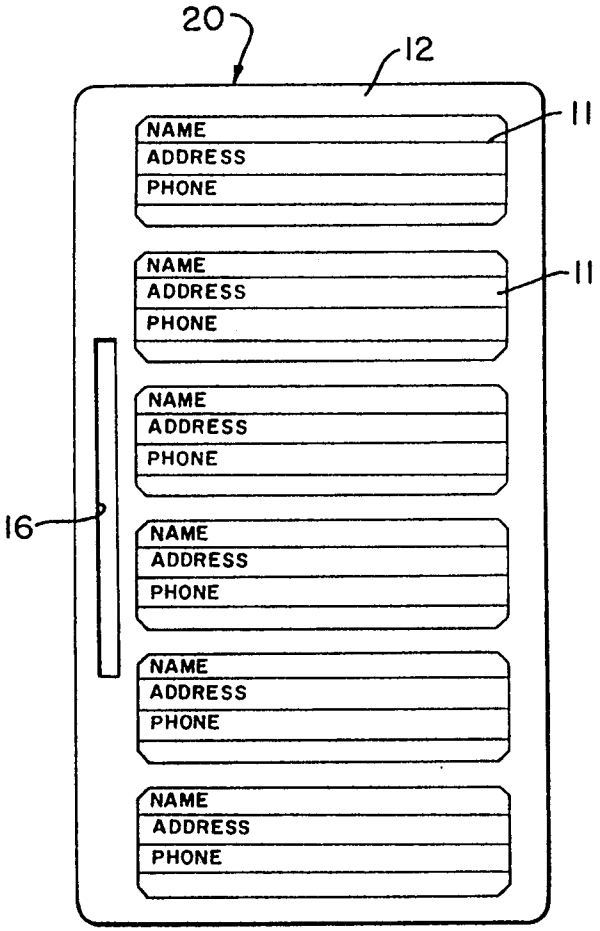
FIG. 4 is a front elevational view of the new page of information carriers with the matrix removed.

Referring to FIG. 2, a new and improved notebook page having repositionable pressure-sensitive adhesive-coated information carries on both the front and rear sides thereof is indicated generally by reference numeral 10. In the illustrated page format both the front and rear sides have five information carriers 11 carried on a linear sheet 12, as shown in FIG. 5. In accordance with the principles of the aforementioned U.S. Pat. No. 4,907,904, each of the information carriers is pre-printed with typical diary information such as name, address, telephone and fax numbers, although other information may be substituted therefor as will be appreciated. In the embodiment of FIG. 2 the information carriers 11 are surrounded by a matrix sheet 13, which matrix 13 has printed repositioning zone indicators 14, which aid the user in repositioning labels properly when they are moved from one position to another in a notebook or diary. Advantageously, the notebook pages are formed having rounded corners 15 and an elongated binder slot 16 for use in looseleaf diary. Individual labels 11 are separable from the matrix 13 by die cuts 17, which circumscribe each of the labels 11, as should be understood. The particular format of the notebook page of FIG. 2, for certain applications such as those illustrated in the U.S. Pat. No. 4,907,904, requires that the matrix 13 be stripped from the carrier 12 to provide individual pages in which only the repositionable pressure-sensitive adhesive information carriers 11 are present. An illustration of such a page is shown in FIG. 4 with that page being indicated generally by reference numeral 20. But for the removal of the matrix 13 from the front and rear surfaces of the liner 12, the notebook page 20 is in all respects identical to the notebook page 10. An important aspect of the production of the notebook pages 10 or 20, as well as the two-sided label stock from which those pages are produced is the usage of a multi-positionable pressure-sensitive adhesive 21 (FIG. 5), which adheres the individual labels 11 to the liner 12.

Figure 1:
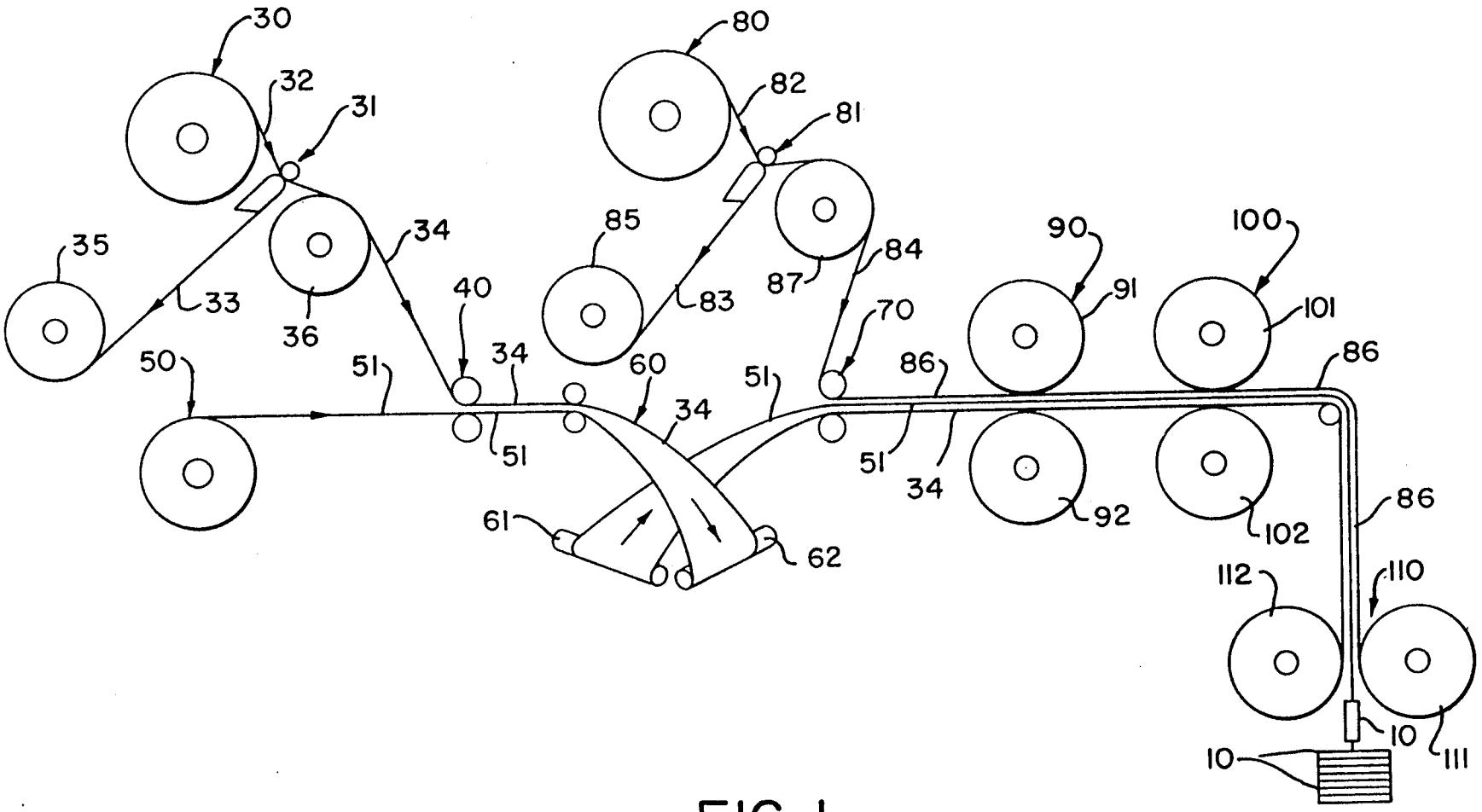
FIG. 1 is a schematic representation of the method and apparatus for carrying out the methods of the present invention.

Referring now to FIG. 1, the two-sided label stock of the present invention may be readily manufactured by mass production techniques as follows. A supply 30 of multi-repositionable pressure-sensitive adhesive coated label stock 32 (comprised of adhesive-coated paper 34 and carrier 33), in which the pressure-sensitive adhesive has been transfer-coated to a silicone release liner or the like is directed around guide roll 36 to a delaminating station 31 where the silicone-coated carrier sheet portion 33 is separated from the paper label stock carrying the transfer-coated multi-positionable pressure-sensitive adhesive 21 (FIG. 5), which pressure-sensitive transfer-coated paper web 34 is directed to first laminating station 40, where it is laminated to a web of liner material 51, which is supplied from a roll 50. The liner material 51 may be calendered or supercalendered paper stock of approximately 54 to 60 pounds weight for notebook pages or it may be a suitable thermoplastic web or any other material which provides inherent release properties to the multi-positionable pressure-sensitive adhesive employed herein. Of course, heavier or lighter liner material may be used for particular applications. At this stage, the liner 51 with the pressure-sensitive repositionable adhesive-coated paper 34 laminated to one surface thereof, is directed through a series of repositioning or rollers 60, 61, 62, where it is then directed to a second laminating nip 70.

A second supply 80 of repositionable pressure-sensitive transfer adhesive-coated paper label stock 80 is directed to a second delaminating nip 81 where the silicone coated carrier 83 is removed from the pressure-sensitive adhesive-coated paper label stock 82, in a manner similar to that described with the first roll 30. The delaminated carriers 83 and 33 are wound into rolls 85 and 35, respectively, and subsequently discarded.

The web of pressure-sensitive adhesive coated label stock 84 is then directed around guide roll 87 to laminating nip 70 where it is joined with the partial laminate comprised of the paper liner 51 or the plastic liner 51 to which label stock 34 had been previously adhered. The coated web 84 is then joined to the liner 51 to form two-sided label stock 86 comprised of liner 51 and label stock 84 on one surface and label stock 34 on the other surface.

Figure 3:
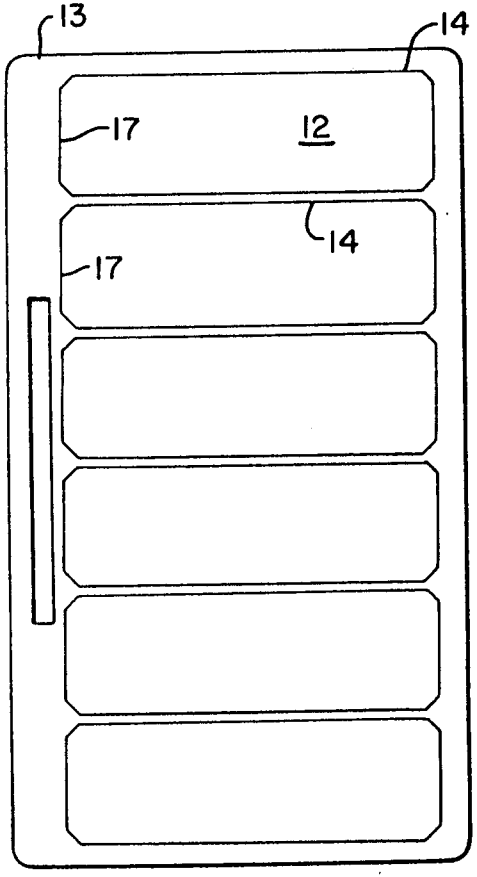
FIG. 3 is front elevational view of the new page with the information carriers removed leaving a matrix having defined zones for attachment of multi-repositionable pressure-sensitive information carriers.

The new and improved two-sided label stock 86 is then directed to a die cutting station 90 where opposed rotary die cutting rolls 91, 92 engage the upper/lower surfaces of the web 86 to form individual labels 11, each of which is circumscribed by die cut 17 in the particular label shape which is desired. Thereafter, the stock 86 is directed to a printing station 100 where inked printing rolls 101 and 102 apply the requisite information to the carriers and/or otherwise tint or color the sheets 84, 34 which are now in the form of matrices 13 (FIGS. 2, 3 and 5) by virtue of having passed through the die cutting station 90.

The two-sided label stock 86 after it is printed and die cut is directed to a sheeting station 110, where the web 86 is cut by rotary cutters 111, 112 into its finished sizes and shapes, such as shown in FIG. 2, where the individual pages have rounded corners and elongated binder slots. The individual sheets 10 are then stacked and assembled into packages for use in notebooks of the type describe more completely in the aforementioned Baldwin U.S. Pat. No. 4,907,904.

While the steps of delaminating the supplied rolls 30 and 80 of multi-positionable pressure-sensitive transfer adhesive-coated label stock and joining the delaminated webs 34, 84 in a sandwiched relation to a liner web 51 are shown in a particular sequence, along with a sequence of printing, die cutting, and sheeting, it is to be understood that the particular steps may be combined or carried out in other sequences as may be found desirable or necessary in a particular application. Likewise, the particular liner sheet 51 which is described hereinabove as being a plastic or a paper which has been calendered or supercalendered and is of a weight of approximately 54 to 60 pounds per ream, (the thickness of the liner being advantageously approximately 2 to 3 millimeters) may be any sheet material having appropriate release properties. Similarly, the multi-repositionable adhesive described hereinabove may be any one of those described in the aforementioned patents (or otherwise chosen so that the adhesive is compatible and readily releasable from the liner sheet 51 and repositionable with respect thereto at least 7 times).

It should be understood that the specific embodiment of the new and improved methods of manufacturing sheet stock having multi-repositionable information carriers on front and rear faces thereof have been illustrated and described herein for the purposes of example only, and that it will be further understood that certain changes may be made therein without departing from the clear teachings of the disclosure. Accordingly, reference should be made to the following appended claims in determining the full scope of the invention.

We claim:

1. A notebook page comprising:

(a) a liner layer;

(b) a first web of paper stock;

(c) a second web of paper stock;

(d) pressure-sensitive adhesive releasably bonding said first and second webs to opposite sides of said liner layer; and (e) binder engaging means formed in a side edge of said page to adapt said page for retention, along with similar pages, in a binder mechanism; wherein said liner layer is calendared paper having uniform surface release characteristics on both sides or plastic having pressure-sensitive release properties; and said first and second webs are repositionable label stock kiss die cut to form removable and repositionable labels within permanent matrices on both sides of said liner layer, said permanent matrices defining zones for repositioning removed labels.

2. The notebook page of claim 1 wherein said binder engaging means is a single elongated slot.

3. The notebook page of claim 1 wherein said repositionable labels and said page have radiused corners.

* * * * *